US005365720A

United States Patent [19]

Bunch

[11] Patent Number: 5,365,720

[45] Date of Patent: Nov. 22, 1994

[54] METHOD OF MAKING WINDOW BAG ASSEMBLY WITH HIGH RESOLUTION GRAPHIC CONTENT REPLICATING INDICIA

[75] Inventor: Joseph Bunch, Lockport, Ill.

[73] Assignee: Bagcraft Corporation of America, Chicago, Ill.

[21] Appl. No.: 887,953

[22] Filed: May 26, 1992

Related U.S. Application Data

[63] Continuation-in-part of Ser. No. 707,857, May 30, 1991, abandoned.

[51] Int. Cl.[5] ..... B65B 11/58; B65B 61/00

[52] U.S. Cl. ..... 53/411; 53/415; 53/449

[58] Field of Search ..... 101/170; 206/459.1, 206/459.5, 457; 229/162; 383/106, 111, 127; 426/106, 124; 493/905, 919; 53/131.2, 131.4, 131.5, 135.2, 136.1, 128.1, 410, 411, 415, 449, 474, 170, 171, 173, 174

[56] References Cited

U.S. PATENT DOCUMENTS

| | | | |
|---|---|---|---|
| 892,074 | 6/1908 | Obici | 426/124 X |
| 2,136,897 | 11/1938 | Thayer | 53/131.4 X |
| 2,703,043 | 3/1955 | Novick et al. | 493/919 X |
| 2,789,689 | 4/1957 | Lewis | 206/459 X |
| 3,312,337 | 4/1967 | Martin | 383/106 X |
| 4,202,450 | 5/1980 | Howell et al. . | |
| 4,559,755 | 12/1985 | Romagnoli | 53/131.5 X |
| 4,672,893 | 6/1987 | Mammarella | 101/170 |
| 4,933,212 | 6/1990 | Gerstner et al. | 101/170 X |
| 4,939,888 | 7/1990 | Katz et al. | 53/411 |
| 4,979,833 | 12/1990 | Cook . | |
| 4,991,980 | 2/1991 | Cohen et al. | 383/106 X |
| 5,117,610 | 6/1992 | Hartman et al. | 53/411 |

FOREIGN PATENT DOCUMENTS

| | | |
|---|---|---|
| 891819 | 3/1962 | United Kingdom . |
| 1400128 | 7/1975 | United Kingdom . |

*Primary Examiner*—John Sipos
*Assistant Examiner*—Linda B. Johnson
*Attorney, Agent, or Firm*—Hill, Steadman & Simpson

[57] ABSTRACT

There is disclosed herein a method for manufacturing a bag-in-a-bag system wherein there is provided a content-carrying sealed and opaque inner bag and a windowed outer bag having a layer in the window-forming graphic content replicating indicia. The graphic layer indicia is of a high quality and is prepared by a high resolution printing technique where the minimum resolution is defined as 160–200 line screen. This type of resolution can be achieved using a rotogravure process. For ease in manufacturing, several indicia are printed on a web, which is then longitudinally slit to separate the indicia and then cut transversely into patches for application to the bag. The bag itself may be printed using a lower resolution technique such as rubber plate printing.

10 Claims, 1 Drawing Sheet

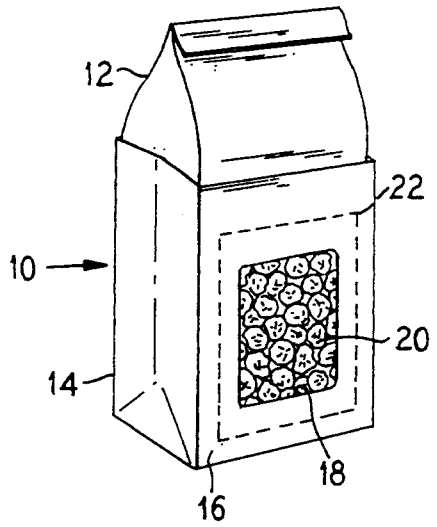
FIG. 1
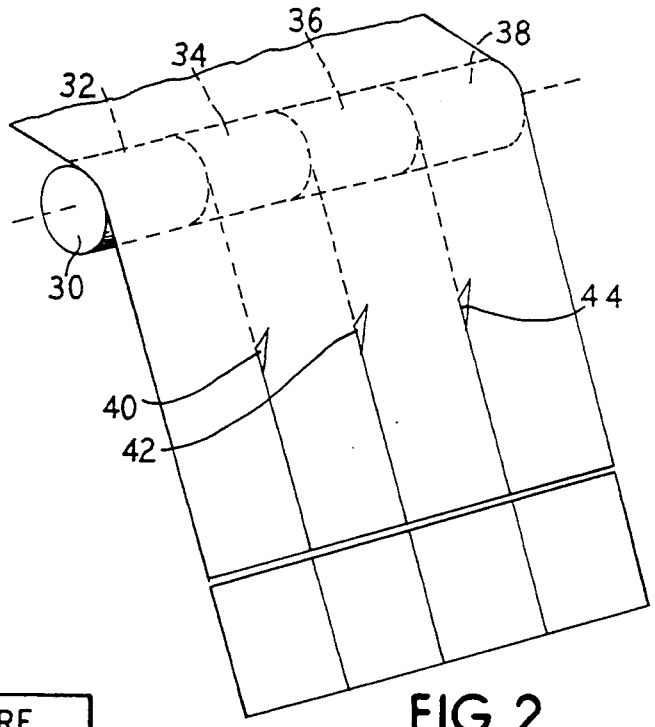
FIG. 2
FIG. 3
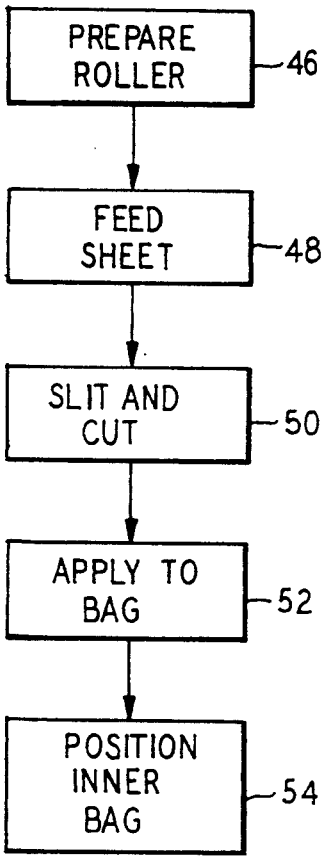

METHOD OF MAKING WINDOW BAG ASSEMBLY WITH HIGH RESOLUTION GRAPHIC CONTENT REPLICATING INDICIA

This application is a continuation-in-part of patent application Ser. No. 707,857 filed May 30, 1991, now abandoned.

BACKGROUND OF THE INVENTION

This invention relates to windowed bag-in-a-bag systems, and more particularly, to a system for producing a high resolution graphic content replicating indicia layer to be displayed in the window.

A bag-in-a-bag system employs a sealed and opaque content-carrying inner bag and a windowed outer bag in which a graphic content replicating indicia layer is secured to the inside of the outer bag so that at least a portion of the graphic indicia is displayed at the window and the layer underlays the window.

This graphic layer is intended to replicate the contents of the bag which can be food items. Use of this layer permits the visual identification of the contents by a purchaser. Furthermore, the contents are carried in an opaque and sealed inner bag and are thus protected from actinic radiation, particularly ultraviolet radiation. Thus, the purchaser can see a replica of the bag contents graphically depicted in the window while the actual contents are protected.

In this system it is important that the graphics accurately depict the contents. In order to so graphically depict the contents, the graphics must be of a high quality which normally means high resolution. Thus lower quality and lower cost printing techniques cannot be used as the reproduction is not satisfactory.

Thus an object of this invention to provide a printed indicia layer of a high quality and resolution for use in a bag-in-a-bag system.

Another object of this invention to provide a printing system which will efficiently produce high-quality layers.

These and other objects of this invention will become apparent from the following disclosure and appended claims.

SUMMARY OF THE INVENTION

There is provided by this invention a high-quality, high-resolution content-replicating graphic indicia layer for a windowed bag-in-bag system wherein the layer is produced efficiently by a high-quality printing system.

The system includes a rotogravure printing system which produces high-quality graphic indicia in which different indicia (e.g., white kernel popcorn, yellow kernel, caramelized, etc.) can be produced on the same rotogravure press. The graphics are printed in longitudinal arrays that can be separated to form strips and then cut transversely into the indicia layers for display in the outer bag's window.

BRIEF DESCRIPTION OF THE DRAWINGS

FIG. 1 is a diagrammatic depiction of a bag-in-a-bag system;

FIG. 2 is a representation of a rotatable plate and web for a rotogravure system; and FIG. 3 is a block-like flow diagram for the present system.

DESCRIPTION OF THE PREFERRED EMBODIMENT

There is disclosed herein a bag-in-a-bag system 10 which includes a sealed opaque content-carrying inner bag 12. The system also includes an outer bag 14 having a front panel 16 that defines an aperture or window 18. A patch 20 has content replicating indicia 22 printed thereon using high resolution printing techniques. A liner may be secured to the inside surface of the front panel so as to position the patch and display content-replicating graphics 22 at the window.

The graphics are of a high quality which accurately reproduces the appearance of the contents. Such a reproduction mechanism provides resolution which is referred to as line screens of at least 160–200 line screen. Resolution of this type can be achieved photographically or by a gravure press. Usually rotogravure techniques are used.

With a rotogravure press the rotogravure cylinder can be thought of in sections and producing different graphic indicia.

For example in FIG. 2, a rotogravure cylinder 30 is shown which can be thought of as having four sections 32, 34, 36 and 38. Each section is for producing a different graphic such as white, yellow, lightly-colored caramelized or heavily colored and caramelized popcorn in the respective sections.

The web exiting the rotogravure press has been printed with indicia and is slit longitudinally by knives such as 40, 42, and 44 so as to produce longitudinal strips of the same indicia that are then cut transversely for use in the bag. After printing the web is slit longitudinally so as to separate the differently printed sections for different bags. These longitudinal strips are cut transversely so as to form patches that can be applied and secured to the inside of a bag, and underlay the window so as to display the indicia printed thereon at the window. If so desired, the outer bag per se may have been printed with text or other material. This bag printing is separate and different than the graphic indicia printing on the layer. The bag can be printed using a lower quality rubber plate printing system. Finally, the content carrying inner bag is fabricated, loaded, sealed and placed into the outer bag.

By using this technique, a purchaser can readily identify the contents of the bag, visually see the nature of the contents and yet the contents are protected by the opaque inner bag and opaque outer bag and indicia layer from actinic resolution which could impact the contents of the bag. Moreover, the quality of the graphics is maximized while the cost minimized as one rotogravure cylinder is used to produce multiple graphics.

The process also can be seen in FIG. 3 which shows a portion of the process in block diagram form where the blocks are identified by numerals 46, 48, 50, 52 and 54. In the process the rotogravure roller is prepared by inscribing the relevant image into a normally non-deformable, usually steel cylinder, see the process box indicated as 46. Thereafter a sheet or web of paper onto which the indicia is to be printed is fed into a printing press as represented by the block at numeral 48. In that operation the sheet is printed.

Thereafter as in step 50 the printed sheet is slit into longitudinal strips and then cut transversely to form the patches. Thereafter the patches are applied to the inside of the bag so as to display the printed indicia at the window. This can be done in a number of ways, one of which is to apply the patch to an adhesive liner and then apply that adhesive liner and patch to the inside of the bag.

Thereafter the inner bag with the contents which is sealed and opaque is positioned and inserted into the outer bag.

Although the invention has been described with respect to preferred embodiments, it is not to be so limited as changes and modifications can be made which are within the full intended scope of the invention as defined by the appended claims.

I claim as my invention:

1. A process for preparing a bag-in-a-bag assembly which includes an inner opaque content-carrying bag and an outer windowed bag within which the inner bag is placed, said outer window bag having a window-defining aperture and a graphic content-replicating patch applied to the inner surface of the outer window bag so as to underlay the aperture and depict ontents of the inner bag, said method comprising the steps of:

(a) determining contents to be carried in the inner bag;

(b) selecting the opaque inner bag to be used in the assembly;

(c) selecting the outer window bag to be used in the assembly;

(d) preparing the content-replicating patch by:

(1) providing an elongated web to be printed with a plurality of longitudinally extending rows of content-replicating graphic indicia, each of said rows being of a single type of indicia and different than an adjacent row;

(2) printing said web with graphic indicia using high resolution techniques which graphic indicia replicates contents to be carried in the inner bag;

(3) separating said longitudinally extending rows into elongated strips of a single type of content-replicating indicia;

(4) forming from each elongated strip a plurality of individual patches to be applied to the outer window bag so as to underlie the aperture;

(e) securing a patch having graphic content-replicating indicia to the inner surface of said outer bag so as to underlay said aperture and expose at least a portion of the content-replicating indicia through said aperture;

(f) so as to depict contents of the inner bag assembly to a viewer of the outer bag;

(g) the outer bag having indicia printed thereon using a lower resolution technique than used for the patch graphic indicia whereby the outer bag is printed using low resolution indicia and the content-replicating patch is printed using high resolution printing.

2. A process as in claim 1, wherein said separating step comprises slitting said web into said elongated strips.

3. A process as in claim 2, wherein said forming step includes transversely severing an elongated strip into a plurality of patches.

4. A process as in claim 1, wherein the printing techniques provide graphic indicia having resolution of at least 160-line screen.

5. A process as in claim 4, wherein the printing technique is of the rotogravure type.

6. A process as in claim 1, wherein the high resolution technique is a rotogravure process and the lower resolution technique uses rubber plate printing.

7. A process as in claim 1, wherein said inner bag is positioned within the outer bag.

8. A process as in claim 1, wherein the inner opaque bag is filled with contents to be carried therein.

9. A process as in claim 8, wherein said inner bag and said outer bag are closed.

10. A process for preparing a bag-in-a-bag assembly which includes an inner opaque content-carrying bag and an outer windowed bag within which the inner bag is placed, said outer window bag having a window-defining aperture and a graphic content-replicating patch applied to the inner surface of the outer window bag so as to underlay the aperture and depict contents of the inner bag, said method comprising the steps of:

(a) determining contents to be carried in the inner bag;

(b) selecting the opaque inner bag to be used in the assembly;

(c) selecting the outer window bag to be used in the assembly;

(d) preparing the content-replicating patch by:

(1) providing an elongated web to be printed with a plurality of longitudinally extending rows of content-replicating graphic indicia, each of said rows being of a single type of indicia and different than an adjacent row;

(2) printing said web with graphic indicia using high resolution rotogravure techniques which provide at least 160-line screen resolution, which graphic indicia replicates contents to be carried in the inner bag;

(3) slitting said longitudinally extending rows into elongated strips of a single type of content-replicating indicia;

(4) transversely severing from each elongated strip a plurality of individual patches to be applied to the outer window bag so as to underlie the aperture;

(e) securing a patch having graphic content-replicating indicia to the inner surface of said outer bag so as to underlay said aperture and expose at least a portion of the content-replicating indicia through said aperture;

(f) printing said outer bag with low resolution indicia which is less than the 160-line screen resolution for the content-replicating indicia, so as to prepare an outer bag with a window having therein a high resolution content-replicating patch, and the outer bag being prepared using low resolution printing and the inner content carrying bag being opaque.

* * * * *